United States Patent [19]

Luther

[11] 4,068,358

[45] Jan. 17, 1978

[54] MACHINE FOR AIR-JET TEXTURIZING OF CONTINUOUS SYNTHETIC FILAMENTS

[75] Inventor: Gerhard Luther, Berlin, Germany

[73] Assignee: Berliner Maschinenbau-AG vormals L. Schwartzkopff, Germany

[21] Appl. No.: 696,506

[22] Filed: June 16, 1976

[30] Foreign Application Priority Data

June 18, 1975 Germany ..... 2527511

[51] Int. Cl.[2] ..... D02G 1/16

[52] U.S. Cl. ..... 28/272

[58] Field of Search ..... 28/1.4, 271, 272, 168; 57/34 B, 90, 140 BL, 157 F

[56] References Cited

U.S. PATENT DOCUMENTS

| | | | |
|---|---|---|---|
| 2,825,118 | 3/1958 | Soussloff et al. | 28/1.4 |
| 2,852,906 | 9/1958 | Breen | 28/1.4 X |
| 3,253,396 | 5/1966 | Fish | 28/1.4 |
| 3,305,910 | 2/1967 | Clement | 28/1.4 |
| 3,328,863 | 7/1967 | Cobb et al. | 28/1.4 |
| 3,381,346 | 5/1968 | Benson | 28/1.4 |
| 3,553,953 | 1/1971 | Ponson | 28/1.4 |

FOREIGN PATENT DOCUMENTS

| | | | |
|---|---|---|---|
| 6,503,706 | 3/1966 | Netherlands | 28/271 |

*Primary Examiner*—Louis K. Rimrodt
*Attorney, Agent, or Firm*—Andrew R. Basile

[57] ABSTRACT

A machine for air-jet texturizing of synthetic filaments equipped with an arbitrary desired number of compressed air-fed texturizing nozzles is disclosed. Each nozzle is supplied with at least two synthetic filaments, and the nozzles are coordinated with at least two supply mechanisms for feeding the filaments to the machine. The supply mechanisms are arranged on axes that are parallel to the longitudinal middle plane of the machine in a common plane directed at an acute angle to the longitudinal middle plane of the machine. The supply mechanisms are offset from each other. The machine further comprises a pressure tank capable of being charged with compressed air and extending over the full length of the machine to provide a supply of air to the texturizing nozzle.

8 Claims, 3 Drawing Figures

1
2
3
4
5
6
7
8
9
10
11
12
13
14
15
16
17
18
19
20
21
22
23
24
25
30
30'
32
6,7,8

MACHINE FOR AIR-JET TEXTURIZING OF CONTINUOUS SYNTHETIC FILAMENTS

BACKGROUND OF THE INVENTION

1. Field of the Invention

The invention concerns a machine for air-jet texturizing of continuous synthetic filaments.

2. Description of the Prior Art

Air-jet texturizing of continuous synthetic filaments is known as such. It involves the use of a nozzle containing the synthetic filament in a jet-nozzle like channel, into which jets of air are directed, cross-wise to or parallel to the direction of filament movement, these airstreams create turbulence, causing the formation of loops, resulting in a volume increase of the processed yarn, and impart a wool-like character.

In order to increase the degree of loop formation, and thus to enhance the degree of texturizing, it is known to the art, to install a rigid or movable impingement surface at a certain distance from the exit opening of the jet nozzle, crosswise to the direction of the issuing filaments and airstream. Both the airstream and the filaments impinge on this surface, causing a deflection from their original direction of movement. The airstream is then vented to the outside, but the additional turbulence caused at the impingement surface causes additional loop formation in the filaments.

Machines equipped with such texturizing nozzles generally provide for an arbitrary desired number of compressed-air-fed texturizing nozzles on both sides of the machine, and each nozzle is supplied with at least two continuous filaments of synthetic manufacture. For these familiar texturizing machines, each nozzle is generally supplied with filaments from a feeder mechanism located vertically to the longitudinal axis plane of the machine, each texturizing nozzle is furthermore connected to a wind-up mechanism which draws off the texturized filaments exiting from the nozzle. The feed rate of the supply mechanism is faster in each case than the drawing-off rate, thus providing for the extra filament length required for the loop formation during the texturizing process. The greater the difference in the speeds of the feed mechanism and wind-up mechanism, the larger is the filament length available for loop formation, so that in effect the manipulation of these speeds allows for changes in the size of the loops formed, and thereby a change in the bulk volume of the texturized yarn. Since each texturizing nozzle is coordinated with a single feed mechanism, all filaments fed to this nozzle are looped in the same fashion. This involves the danger that when the texturized yarn is stretched during further processing, or even during normal usage of a clothing article made from texturized yarn, the loops may be pulled out, so that the texturized yarn will change in diameter, and thereby in bulk, a totally undesired effect, which is therefore considered a disadvantage of the state of the art machines. In order to limit the pulling out of the loops produced by texturizing, it is customary to use a number of filaments, this for the purpose of achieving an interlocking of the loops formed in the individual filaments and imparting more permanent bulk to the texturized yarn, in this manner counteracting to a certain extent any subsequent stress resulting from stretching. In order to bring about the most intensive interlocking of loops created in individual filaments, one is forced to subject a larger number of filaments, i.e. a filament bundle, to the texturizing process. Since, however, such interlocking of loops to a great extent depends on arbitrary conditions, a uniform interlocking over the total length of the texturized yarn cannot be achieved, so that on stretching, the yarn will decrease in diameter at those locations where insufficient interlocking exists, and thereby becomes nonuniform.

The compressed air is supplied to the individual texturizing nozzles via a compressed air pipe located on both sides of the machine, to which each texturizing nozzle is connected in parallel fashion. Of necessity, during normal running some texturizing nozzles are shut off, and then again put in service. This causes pressure variations in the compressed air line, which in turn translate to the textured yarn, causing irregularities, and uneven texturizing, again a considerable disadvantage of the known, state of the art machines. It is of course an inherently understood objective of such a machine to produce uniformly texturized yarn from all of the texturizing nozzles. It is the objective of this invention to avoid these disadvantages, and to describe a machine for air texturizing of continuous synthetic filaments, which is simple in construction, provides for trouble-free processing, and guarantees uniform texturizing from all nozzles, resulting in yarn of uniform bulk which retains its uniform character during further processing. At the same time, the machine according to this invention, provides for optimal variability of the texturizing process, to an extent not possible by the present state of the art machines.

SUMMARY OF THE INVENTION

According to the present invention, this objective is achieved by providing for at least two filament supply mechanisms for each texturizing nozzle. The axis of these supply mechanisms are arranged parallel to the longitudinal middle plane of the machine, preferably in a common plane at an acute angle to the plane of the machine, and the individual arrangement of said supply mechanisms is offset to each other. In addition a pressure vessel, extending the length of the machine, is provided for supplying the texturizing nozzles with compressed air. Because of the fact that each texturizing nozzle is coordinated not only with one, but several, filament supply mechanisms, an advantageous possibility to vary the nature of the texturized yarn is provided, in comparison with the state of the art machines. The respective supply mechanisms may carry either a single filament, or may carry several filaments of varying number, they may be driven at different speeds, resulting in varying types of loop formation in the texturizing nozzle supplied by them. The overall effect is that, depending on the number of filaments in each feed component, and the differing loop size generated, a varying characteristic texturizing is achieved. The overall color appearance of the texturized yarn can also be modified through the use of differently dyed filaments for the individual components. Such effects are achievable by the enhanced color effect produced from the larger loops of one feed component. In addition, the tensile strength of the texturized yarn can be advantageously affected by the multiple supply mechanism feature; one, or several, of the individual filaments may for instance be provided with smaller loops, which reduces the danger of such loops being pulled out during the further processing of the yarn. The arrangement of the feeder mechanisms, on axis parallel to the medium plane of the machine, offers an advantage over the familiar vertical arrangement of the feeder mechanisms, insofar as it allows for essentially simpler construction, due to the fact that all feeder mechanisms on one axis, can be directly driven by one continuous shaft, the guide pulley drives, required for the vertical arrangement of feeder rolls, become superfluous. In addition, the guide rolls for the change of direction of the filaments, as needed in case of vertically arranged feeder mechanisms, also become superfluous, again a significant simplification in machine design and construction. This fact is of decisive importance for the described machine with its larger number of supply mechanisms. Additionally, a space saving arrangement of the feeder mechanisms coordinated to each texturizing nozzle is only made possible by the axis parallel arrangement with reference to the longitudinal middle plane of the machine. The arrangement of the supply mechanisms in a plane which is preferably slanted, with respect to the longitudinal middle plane of the machine, provides for the possibility that the individual filaments are fed to the nozzle channel preferably in one single plane, this implies a manner of feeding during which individual filament components only make contact with each other at the entrance to the nozzle, and thereby provides for trouble-free running. Normally, when individual filament components from different feeder mechanisms make contact with each other, especially in the case of differing feed rates, trouble and processing upsets are virtually guaranteed. The pressure vessel provided according to the present invention, pressurized with air, has the advantage that a manifold larger pressurized air volume is available for feeding the nozzles, the larger air volume provides a buffer capacity, so that any pressure variations, caused by shutting off or reconnecting individual texturizing nozzles, are substantially reduced in their disadvantageous effect on the evenness of texturizing, than is the case with machines according to the present state of the art. Based on the patented characteristics, it is possible to design a machine which is inherently simple in construction, and will perform trouble free, guaranteeing a uniformly texturized product from all texturizing nozzles, a product which retains its texture during further processing, and at the same time provides for an optimal variability of the type of texturizing desired.

It is a further characteristic of the instant invention that the pressure vessel is arranged in the longitudinal middle plane of the machine, and in horizontal installation, and that attached to this vessel a pressure box is provided which contains the texturizing nozzles located on both sides of the pressure vessel.

It is a further characteristic of the instant invention that the pressure vessel is designed in loop form, containing the pressure box between the two loop sections, and feeding the pressure box from one of the loops, and that these functional elements at the same time serve as structural elements of the machine. The circular pressure vessel, arranged in the longitudinal middle plane, provides for uniform feed pressure to all texturizing nozzles arranged on both sides of it, which guarantees a uniform texturizing process. The design of the pressure vessel as a circular loop brings the additional advantage that air pressure variations in the vessel are no longer able to have a disadvantageous influence on the texturizing process; due to the fact that compressed air is provided to the nozzles from both loops, so that the air provided by the closed loop section is always of uniform pressure.

It is a further characteristic of the instant invention that the jet nozzle box is designed as a closed box, serving as a sound attenuating element. Its design provides for an opening for the filaments fed to the nozzle, and for an exit for the texturized yarn leaving the nozzle. Because the nozzle box has the effect of a sound absorber, the running noise caused by the compressed air is reduced to a level which is not found troublesome. Also, the openings provided in the nozzle box as guides for the filaments, guarantee that no contact is possible between the filament components prior to entry into the texturizing nozzle.

It is a further characteristic of the present invention that the feeder mechanisms for the supply of filaments can be run at variable speeds. By means of these variable speed feeder mechanisms, different loop formations can be achieved in the filaments supplied by each mechanism.

A further characteristic of the invention is to be found in the fact that a given feeder mechanism used for supplying filaments can be run at the same speed as a take-up mechanism used for winding up the textured yarn. The identical speed driving of feeder and take-up mechanism achieves that the respectively processed filament is not subject to loop formation at all, i.e. serves as core fiber, and prevents the pulling out of the loops of the other filaments supplied from the other feeder mechanisms. Thus, on further processing, and under tensile stress, a pulling out of the imparted loops is effectively prevented.

Furthermore, it is essential that one of the feeder mechanisms can be driven at speeds which may be periodically, or aperiodically, variable. In this context, one feeder mechanism may be driven at the same speed as the respective take-up roll, a second feeder mechanism may be running at a higher speed, providing for loop formation, while a third feeder mechanism may run at a different speed, also allowing for loop formation, however, under conditions where its speed is periodically or arbitrarily varied, so that the filament provided by it serves the purpose of achieving a so-called effect-yarn, i.e. a yarn which at predetermined locations is characterized by additional reinforced nodes or loop strength sections.

A further characteristic of the invention is to be found in the fact that the supply mechanisms, serving for the feeding of the filaments, are provided with devices 30 for imparting a certain moisture content to the filaments, such devices 30 being in themselves known to the art; in addition a heating device 32 is provided for the filaments at the exit from the texturizing nozzle, for the purpose of stabilizing or heat-setting the textured yarn, again such features are known to the art. The installation of a moisturizing device serves to improve the loop formation during the turbulent processing phase and as a matter of experience, the heating device serves the purpose of reducing the shrinkage capability of the texturized yarn, and to thereby preserve the formed loops also in the woven state; the tensile stresses arising during further processing are thereby minimized. The presence of a moisturizing device, and the heating device, allows the machine to also texturize a single synthetic filament, since the loops formed in such a single filament are subsequently stabilized by the heat-setting stage.

It is furthermore a characteristic of the invention that when using unstretched, or only partially stretched filaments, additional drawing mechanisms or auxiliary devices for drawing the filament, are installed upstream from the feeder mechanisms as such. This allows the use of the machine also for unstretched, or only partially stretched, feed material.

Finally, it is of importance that as take-up packages for the texturized yarn a cone-shaped spool is used, and that the windup spool is preceeded by a compensating device which serves to compensate for the constant speed of the windup mechanism. The use of a cone-shaped windup spool brings the advantage that during further processing, when unwinding the spool from overhead, the textured yarn can run off freely, i.e. without friction, and the texture-loops remain unimpaired; in case of a cylindrical take-up spool, the textured yarn or removal is subject to friction on the cylinder surface of the spool, allowing for disadvantageous effects on the texture-loops.

BRIEF DESCRIPTION OF THE DRAWING

The attached drawing shows, in schematic presentation, a specific design example of the machine according to the present invention.

DESCRIPTION OF THE PREFERRED EMBODIMENT

Figures 1, 2, 3:
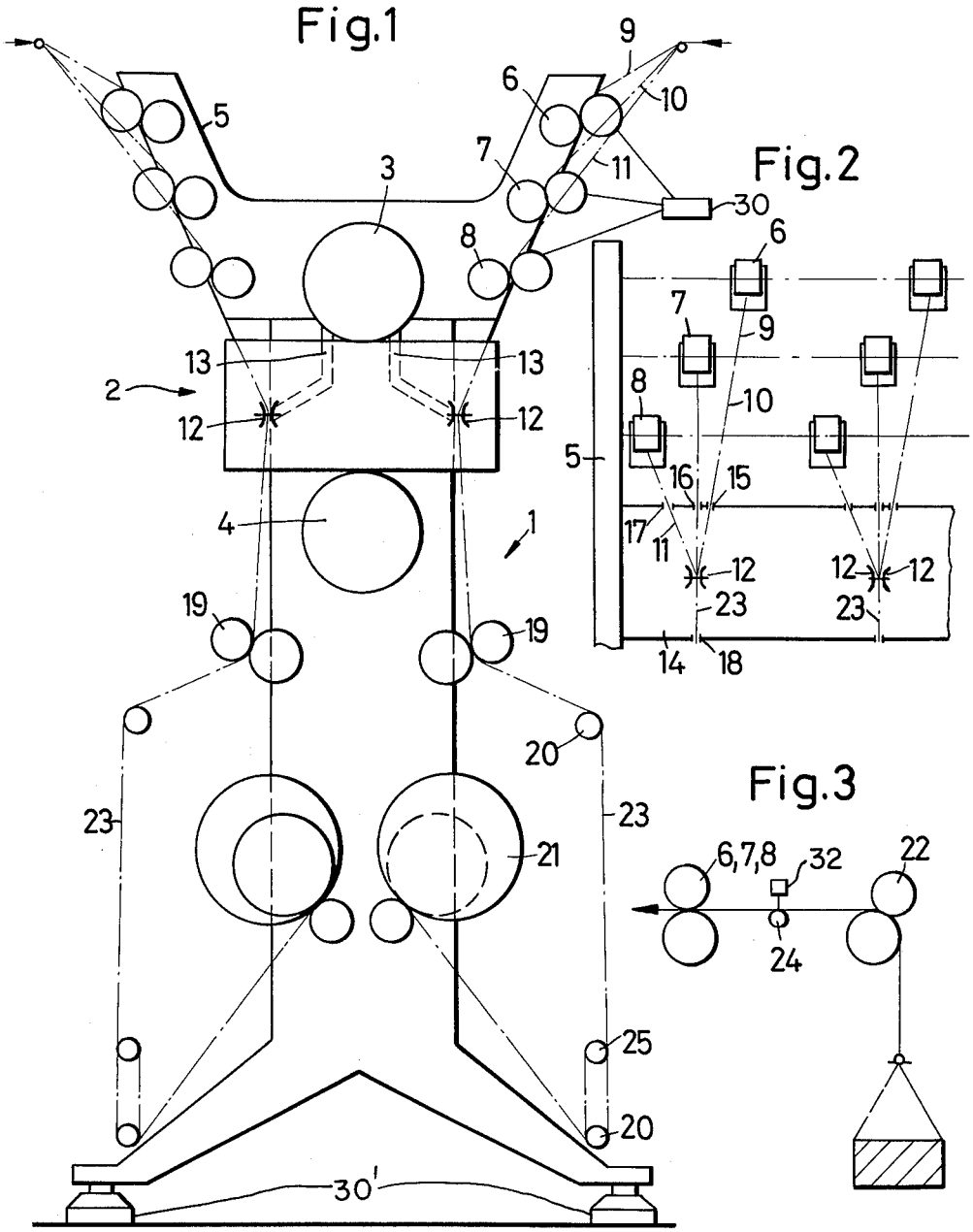
FIG. 1 presents a side view of the machine.
FIG. 2 presents a partial front view in line with FIG. 1.
FIG. 3 presents a schematic presentation of the drawing mechanisms, or auxiliary drawing mechanisms, installed before the feeder mechanisms of the machine.

The machine 1 is equipped with a tank 2, located in the longitudinal middle plane, and extending across the full length of the machine, said tank 2 consists of an upper section 3, and a lower section 4, both sections being joined at their ends to form a closed loop system; compressed air is fed to the closed loop tank system between the two sections 3 and 4, by means of a compressed air supply source, which is not represented in the drawing.

Mounted on tank 2, which forms the structural element of machine 1, are plate like structural carriers 5, arranged at specified distances. These carrier plates provide the mounting base for the mechanical devices required for the operation of the machine, and at their lower ends are provided with pedestals 30'. On the upper end branches of carrier plates 5 are mounted drive shafts for the supply mechanisms 6, 7, 8; these drive shafts are arranged parallel to the longitudinal axis of machine 1. Supply mechanisms 6, 7, 8 are located in a plane which is directionally at an acute angle to the longitudinal plane of machine 1, and, as demonstrated by FIG. 2, are offset to each other in length-wise direction.

Via supply or feeder mechanisms 6, 7, 8, individual filaments 9, 10, and 11 are pulled off feeder spools, which are not represented in the drawing, and fed to a texturizing nozzle 12 of known design. The nozzle channel is vertical in direction, and is structurally located in the acute angle plane of feeder mechanisms 6, 7, and 8.

As shown in FIGS. 1 and 2, texturizing nozzles 12 are arranged on both sides of tank 2 of machine 1; they are mounted alongside tank 2 at certain distances from each other, and each nozzle is coordinated with a supply mechanism 6, 7, and 8. Texturizing nozzles 12 are connected via piping 13 with the upper section 3 of the circular tank 2, so that they are supplied with compressed air from this reservoir; the compressed air, by this design, flows to piping 13, and thereby to texturizing nozzles 12, both from the upper section 3, and also from the lower, closed section 4 of tank 2. As a result of this design for the flow of the compressed air, and in consequence of the ballast capacity provided by tank 2, the pressure variations resulting from putting pipes 13 in or out of service, do not disadvantageously affect the uniformity of the texturizing process. The texturizing nozzles 12, arranged bilaterally to tank 2, are mounted within jet nozzle box 14, which itself is contained between the sections 3, and 4, of tank 2; said jet nozzle box 14 protects the nozzles against damage, and simultaneously acts as a sound attenuating device for the noise produced by the compressed air. Jet nozzle box 14 is provided with openings 15, 16, and 17 on its top surface. These openings serve as guides for filaments 9, 10, and 11, and at the same time prevent their coming in contact with each other prior to entry into the jet nozzle canal. The texturized yarns 23, which exit from jet nozzles 12 in a downward direction, are removed via exit openings 18 in the bottom surface of jet nozzle box 14. Openings 15 through 18, at the same time serve as exit ports for the compressed air coming from texturizing nozzles 12.

Below each texturizing nozzle 12, a windup withdrawal mechanism 19 is provided, serving to withdraw the texturized yarn 23, produced by loop formation from the individual filaments 9, 10, and 11. The texturized yarn 23 is wound up on spools 21 via guide rolls 20.

The windup spool 21 is a conical spool, as represented by the dashed line drawing. Since the windup spool 21 has to run with constant speed, in order to provide for uniform texturizing, an additional movable guide roll 25 is provided in the path of the texturized yarn 23. This arrangement, in conjunction with guide roll 20, provides for an equalizing device with the overall effect of providing for uniform windup of the texturized yarn 23 on conical spool 21, despite the uniform speed of the withdrawal mechanism 19. The additional guide roll 25 is under spring tension and maintains the texturized yarn 23 in taught condition between withdrawal mechanism 19 and windup spool 21; thus uniform yarn windup is guaranteed on spool 21 while providing for a constant feed length via withdrawal mechanism 19. By choosing springs of different tension, the package hardness of conical spool 21 can be varied, so that with suitable selection of a respective spring, packages ready for dyeing can also be produced. The possibility of using springs of different tension for the additional guide roll is thus an essential characteristic of the invention.

In order to allow for loop formation in filaments 9, 10, and 11, the feeder mechanisms 6, 7, and 8 must be driven at a higher rate of speed than the withdrawing mechanism 19. In order to form a core fiber, capable of accepting tensile stresses in the texturized yarn 23, i.e. a filter which does not contain loops, one of the supply mechanisms, e.g. mechanism 8, can be driven with the same speed as withdrawal mechanism 19, while the other supply mechanisms 6, 7 are driven at higher speeds, or at different higher speeds. One of the two feeder mechanisms 6, 7 in addition may be driven at a periodically or aperiodically changing higher speed, in order to result in the production of a so-called effect-yarn, i.e. a texturized yarn which at certain distances, determined by the speed variations, exhibits thicker portions in the form of nodally denser sections.

To this purpose, machine 1 is provided with a combined drive mechanism, not represented in the drawing, which drives directly the drive shafts of feeder mechanisms 8, and 19, mounted parallel to the axis of tank 2, while feeder mechanisms 6, and 7, are driven from these drive shafts via transmission gears which can be set at different transmission ratios.

In order to allow for the processing by the machine of undrawn, or only partially drawn, filaments, drawing mechanisms are installed upstream of the feeder mechanisms 6 to 8, these drawing mechanisms 22 are in themselves familiar and state of the art devices. They serve to stretch the filaments between feeder rolls 22 and supply mechanisms 6 to 8, and to this effect are provided with an auxiliary cam 24 which can be heated by the device 32, and is passed by filaments 9 to 11.

Texturizing nozzles 12, as indicated in FIG. 1, may be arranged with a vertical nozzle channel through which filaments 9, 10, 11 pass; however it has been found that a better texturizing effect can be achieved if nozzles 12 are mounted in such a manner that the nozzle channel extends crosswise, preferably in horizontal direction. This latter arrangement of the texturizing nozzle 12 is also an essential characteristic of the present invention.

While only one example of applicant's invention has been disclosed, it should be understood by those skilled in the art of air-jet texturizing machines that other forms of applicant's invention may be had, all coming within the spirit of applicant's invention and the scope of the accompanying claims.

I claim:

1. In a machine for the air-jet texturizing of synthetic continuous filaments, said machine having a plurality of texturizing nozzles which are connected to compressed air; the texturizing nozzles having channels directed in a vertical direction;

supply mechanisms for guiding at least two synthetic continuous filaments to each nozzle, said supply mechanism being located with their axes parallel to the longitudinal plane of said machine;

an improvement comprising at least two supply mechanisms for each nozzle, each supply mechanism supplying a continuous filament, said supply mechanism being located in a common plane directed at an acute angle with respect to the longitudinal middle plane of the machine, said supply mechanisms being offset with respect to each other in their plane in the longitudinal direction of the machine;

a vessel which is filled with compressed air, said vessel extending over the entire length of said machine, said vessel serving to supply said texturizing nozzle; and a nozzle box attached to the vessel, said nozzle box containing said texturizing nozzles which are located on both sides of said vessel, said texturizing nozzles being located in the plane which is formed by said supply mechanisms, said vessel supplying the texturizing nozzles from at least one branch; said nozzle box having a plurality of openings corresponding to the number of said filaments for guiding said filaments toward said nozzles to prevent their coming into contact with each other prior to entry into said jet nozzle channels.

2. Claimed is, a machine according to claim 1, characterized by the fact that jet nozzle box (14) is designed as a closed container for the purpose of sound attenuation, and is also provided with an opening (18) for the texturized yarn exiting from the texturizing nozzle.

3. Claimed is, a machine according to claim 1, characterized by the fact that supply mechanisms (6 to 8), serving to feed filaments (9 to 11) can be driven at different speeds.

4. Claimed is, a machine according to claim 1, characterized by the fact that one of the supply mechanisms (8) for the filament can be driven at the same speed as the windup mechanism (19) used for taking off the texturized yarn (23).

5. Claimed is, a machine according to claim 1, characterized by the fact that one of the supply mechanisms (7) can be driven with a periodically, or aperiodically changing speed for the purpose of achieving a so-called effect-yarn.

6. Claimed is, a machine according to claim 1, characterized by the fact that a by itself familiar moisturizing device is coordinated with supply mechanisms (6 to 8) which serve for the feeding of filaments (9 to 11), and that by itself a known heating device is coordinated, for purposes of stabilizing or heat-shrinking, with the textured yarn (23) exiting from the texturizing nozzle.

7. Claimed is, a machine according to claim 1, characterized by the fact that during processing of undrawn, or partially undrawn filaments, additional drawing devices (22), and auxiliary drawing devices (24), are installed upstream of supply mechanisms (6 to 8).

8. Claimed is, a machine according to claim 1, characterized by the fact that the windup spool (21) for the texturized yarn (23) is a conical spool, and that before said windup spool (21) a compensating equalizing device (25) is installed, for the purpose of allowing said withdrawing mechanism (19) to run at constant speed.

* * * * *